US007624539B2

(12) United States Patent
Speyer et al.

(10) Patent No.: US 7,624,539 B2
(45) Date of Patent: Dec. 1, 2009

(54) COMBINED SEALING SYSTEMS FOR PIVOTING DOOR/WINDOW

(75) Inventors: William Kip Speyer, Boca Raton, FL (US); Jonathan D Thielmann, Boca Raton, FL (US)

(73) Assignee: Speyer Door and Window, Inc., Boca Raton, FL (US)

( * ) Notice: Subject to any disclaimer, the term of this patent is extended or adjusted under 35 U.S.C. 154(b) by 619 days.

(21) Appl. No.: 11/425,377

(22) Filed: Jun. 20, 2006

(65) Prior Publication Data

US 2007/0175118 A1 Aug. 2, 2007

Related U.S. Application Data

(63) Continuation-in-part of application No. 11/322,953, filed on Dec. 30, 2005.

(51) Int. Cl.
*E06B 7/16* (2006.01)
*E06B 3/26* (2006.01)
*E06B 3/40* (2006.01)

(52) U.S. Cl. ..... 49/484.1; 49/316; 49/381; 49/388; 49/483.1; 49/490.1; 49/489.1; 49/475.1; 52/210; 52/213; 52/204.54

(58) Field of Classification Search ..... 49/220, 49/219, 449, 450, 451, 483.1, 484.1, 495.1, 49/490.1, 489.1, 142, 275, 316–321, 324, 49/339, 363, 381, 388, 383, 475.1; 52/204.1, 52/210–213, 204.51, 204.64, 204.597, 204.54, 52/204.71

See application file for complete search history.

(56) References Cited

U.S. PATENT DOCUMENTS 724,139 A 3/1903 Smith
1,675,230 A * 6/1928 Snyder ..... 292/213
1,995,939 A 3/1935 Osten
2,552,369 A 5/1951 Currie
2,628,678 A * 2/1953 Webster ..... 160/90
2,862,262 A 12/1958 Shea
3,004,309 A 10/1961 Korodi
3,054,152 A * 9/1962 Trammell, Jr. ..... 49/430
3,070,856 A 1/1963 Minick
3,098,519 A 7/1963 Myers et al.
3,111,727 A * 11/1963 Gerecke ..... 52/204.51
3,163,891 A * 1/1965 Seliger ..... 49/395

(Continued)

OTHER PUBLICATIONS

Patio Life—Operation; http://www.rotohardware.com/Products/Patio%20Life/PL-Operation.htm.

*Primary Examiner*—Jeanette Chapman
(74) *Attorney, Agent, or Firm*—Scott D. Paul, Esq.; Steven M. Greenberg, Esq.; Carey, Rodriguez, Greenberg & Paul, LLP

(57) ABSTRACT

A combined sealing system for connecting a panel to a frame includes a first sealing system and a second sealing system. The panel pivots relative to the frame. The first sealing system connects a first surface of the panel to a first surface of the frame, and the second sealing system connects a second surface of the panel to a second surface of the frame. The first surface of the panel is different than the second surface of the panel, and the first and second sealing systems have a locked configuration and an unlocked configuration upon the panel being positioned within the frame.

14 Claims, 7 Drawing Sheets

U.S. PATENT DOCUMENTS

| | | | | |
|---|---|---|---|---|
| 3,383,801 | A | | 5/1968 | Dallaire |
| 3,465,801 | A | | 9/1969 | Bohn |
| 3,818,636 | A | | 6/1974 | Calais et al |
| 3,857,199 | A | | 12/1974 | Frach et al. |
| 4,317,312 | A | * | 3/1982 | Heideman ..... 49/220 |
| 4,413,446 | A | | 11/1983 | Dittrich |
| 4,535,563 | A | | 8/1985 | Mesnel |
| 4,870,909 | A | | 10/1989 | Richter |
| 4,936,049 | A | | 6/1990 | Hansen |
| 5,007,202 | A | | 4/1991 | Guillon |
| 5,029,911 | A | | 7/1991 | Daniels |
| 5,339,881 | A | | 8/1994 | Owens |
| 5,870,859 | A | | 2/1999 | Kitada |
| 6,082,047 | A | | 7/2000 | Comaglio et al. |
| 6,173,533 | B1 | | 1/2001 | Cittadini et al. |
| 6,243,999 | B1 | | 6/2001 | Silverman |
| 6,289,643 | B1 | | 9/2001 | Bonar |
| 6,442,899 | B1 | | 9/2002 | Gledhill |
| 6,490,832 | B1 | | 12/2002 | Fischbach et al. |
| D470,252 | S | | 2/2003 | Castrey |
| 6,644,884 | B2 | | 11/2003 | Gledhill |
| 6,651,389 | B2 | | 11/2003 | Minter |
| 2005/0097842 | A1 | | 5/2005 | Arcamonte et al. |

* cited by examiner

COMBINED SEALING SYSTEMS FOR PIVOTING DOOR/WINDOW

CROSS-REFERENCE TO RELATED APPLICATIONS

This application is a Continuation-In-Part of U.S. application Ser. No. 11/322,953, filed on Dec. 30, 2005, incorporated herein by reference in its entirety.

BACKGROUND OF THE INVENTION

1. Field of the Invention

The disclosure relates generally to sealing systems for use with panels, such as a door or a window, within a frame and, more specifically, to a sealing system for providing an improved seal between a panel and frame.

2. Description of the Related Art

Certain types of panels, such as doors and windows, are positioned within openings of a wall and/or other structures using a frame. These panels may also open and close by pivoting relative to the frame. An issue associated with these types of panels is the integrity of the seals between the panels and the frame. In many instances, these seals are an insufficient barrier in preventing the transfer such environmental elements as noise, weather, water, and insects from one side of the panel to the other side.

Attempts have been made to address these issues by using various types of weather stripping between the panels and frame. For example, the weather stripping may be strip of felt, foam, or a pile of flexible synthetic material. In many instances, however, this weather stripping fails to act as a sufficient seal between the panels and frame. Another issue prevalent associated with the seals between a frame and panel or between adjacent panels is that these seals can become disjoined. Either intentionally or unintentionally, the alignment between the frame and panel or between adjacent panels may be disturbed which can degrade the quality of the seal, since, in many instances, the integrity of the seal relies upon these members having certain positional relationships relative to one another.

There is, therefore, also a need for a sealing system that maintains the positional relationships between the frame and panel. There is also a need for a sealing system that can be employed between a frame and panel that prevents the transfer from one side of the panel to the other side of the panel such environmental effects as noise, weather, water, heat/cold, and insects.

BRIEF SUMMARY OF THE INVENTION

Embodiments of the invention address deficiencies of the art with respect to effectively creating a seal between a panel and a frame. In this regard, a combined sealing system for connecting a panel to a frame includes a first sealing system and a second sealing system. The panel pivots relative to the frame. The first sealing system connects a first surface of the panel to a first surface of the frame, and the second sealing system connects a second surface of the panel to a second surface of the frame. The first surface of the panel is different than the second surface of the panel, and the first and second sealing systems have a locked configuration and an unlocked configuration upon the panel being positioned within the frame.

In certain aspects of the combined sealing system, sealing systems are provided to respectively connect all pairs of adjacent surfaces of the panel and the frame. Also, engagement of the first sealing system causes engagement of at least one or all of the other sealing systems.

In other aspects of the combined sealing system, the first sealing system provides a seal between an entire first surface of the panel to the first surface of the frame. The first sealing system includes an anchor positioned in either the frame or the panel and a slot positioned in the other of the frame and the panel. In certain aspects, the slot is positioned in the panel and the anchor is positioned in the frame in an unlocked configuration. In the locked configuration, the anchor engages a surface of the slot to form a seal between the anchor and the slot.

In further aspects of the combined sealing system, the first sealing system is adjacent to and engages the second sealing system, and the first sealing system includes at least one cam positioned within the frame. The cam engages a sealing frame, and the sealing frame engages the second sealing system. The first surface of the panel is positioned opposite the second surface of the panel. The sealing frame also engages a third sealing system and a fourth sealing system, which each include at least one adjacent pair of steps. Relative movement between the adjacent pair of steps causes engagement of the third and fourth sealing systems, and one of the adjacent pair of steps is connected to the sealing frame.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1A:
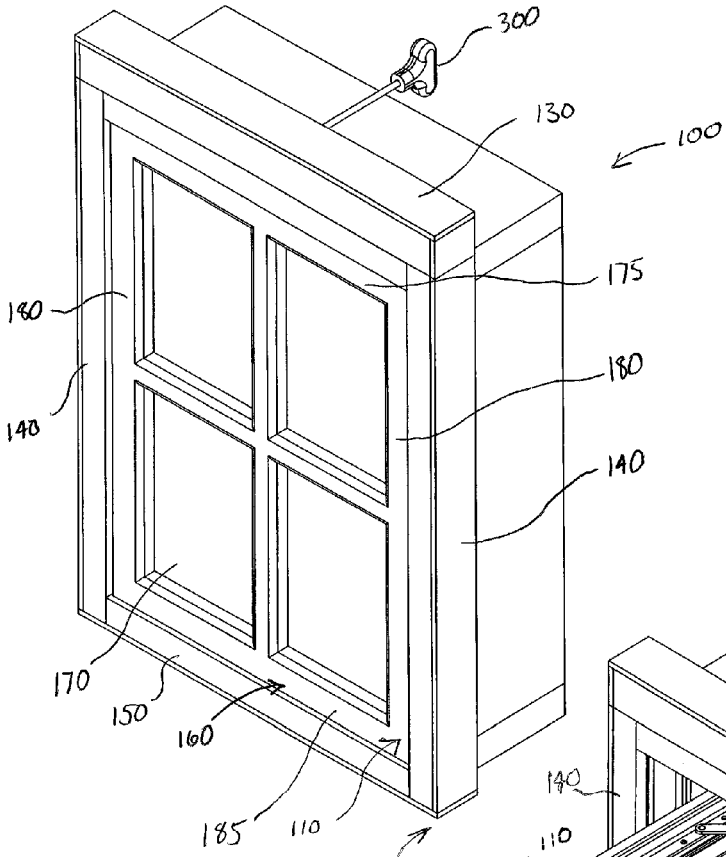
FIGS. 1A and 1B are perspective views, respectively, of a door/window system in a closed and open position in accordance with the inventive arrangements.
Figure 1B:
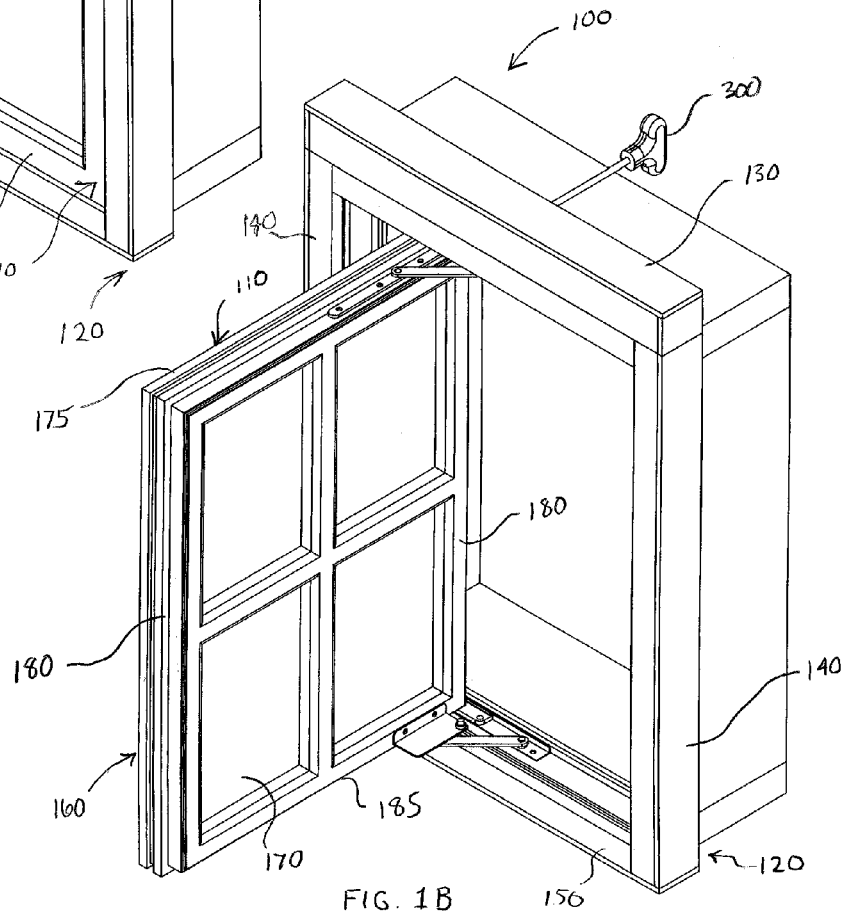

FIGS. 1A and 1B illustrate an exemplar door/window system 100 for use with the improved sealing system 200. The sealing system 200 can be used with many types of doors and/or windows, and the sealing system 200 is not limited to the particular door/window system 100 illustrated. For example, the sealing system 200 may be used with pocket doors, sliding doors, French doors, entry doors, garage doors, sliding windows, single-hung windows, double-hung windows, casement windows, and awning windows. The door/window system 100 includes at least one panel 110 connected to a stationary frame 120. Although not limited in this manner, the panel 110 may pivot relative to the frame 120.

The frame 120 may include a header 130, jambs 140, and a sill 150. A header 130 is a structural member that spans an upper portion of the window/door opening. Jambs 140 are the outermost vertical side members of the frame 120. A sill 150 is a threshold or structural member that spans a lower-most portion of the window/door opening. As recognized by those skilled in the art, different terms may also be associated with the above-structure identified as the header 130, jambs 140, and sill 150.

Each panel 110 may include a sash 160 that surrounds a pane 170. The pane 170 is not limited as to a particular material. For example, the pane 170 may be translucent, such as glass or plastic, opaque, such as with wood or metal, or any combination thereof. The sash may include a header rail 175, jamb or stile rails 180, and a sill rail 185. As recognized by those skilled in the art, different terms may also be associated with the structure identified as the header rail 175, the jamb or stile rail 180, and sill rail 185.

The sealing system 200 (see FIGS. 5A-5C, 6A-6C, 7A-7C) may be used with each of the members 175, 180, 185 of the sash 160 to form a seal between each pair of adjacent surfaces of the sash 160 of the panel 110 and the frame 120. In this manner, each of the separate sides of the panel 110 may employ the sealing system 200. As will be described in more detail below, not only does the sealing system 200 provide at least one seal between adjacent members of sash 160 and frame 120, each of the sealing systems 200 may be configured prevent the movement of the panel 110 relative to the frame 120. In so doing, the sealing systems 200 can act as a lock and/or security device that prevents the forced opening of the panel 110 relative to the frame 120. Many types of sealing systems 200 so capable are known in the art, and the present door/window system 100 is not limited as to a particular type of sealing system 200.

Additionally, although the present door/window system 100 is described herein with particular types of sealing systems 200 being positioned in particular locations, the door/window system 100 is not limited as to a particular type of sealing system 200 or a particular location of the sealing system 200. For example, a sealing system 200 employing one or more cams 210 may be positioned within the jambs 140 and/or the sill 150.

To prevent the forced opening of the panel 110, the sealing systems 200 are not limited as to a percentage of coverage between particular members of the frame 120 and/or panel 110. For example, the sealing systems 200 may only cover a fractional number (e.g., 10%, 50%, 85%) of the length between particular members of the frame 120 and/or panel 110. However, in certain aspects, the sealing systems 200 provide substantially complete coverage between the sash 160 of a panel 110 and the frame 120. In so doing, the combined sealing systems 200 can provide a seal substantially completely around the panel 110.

Figure 2A:
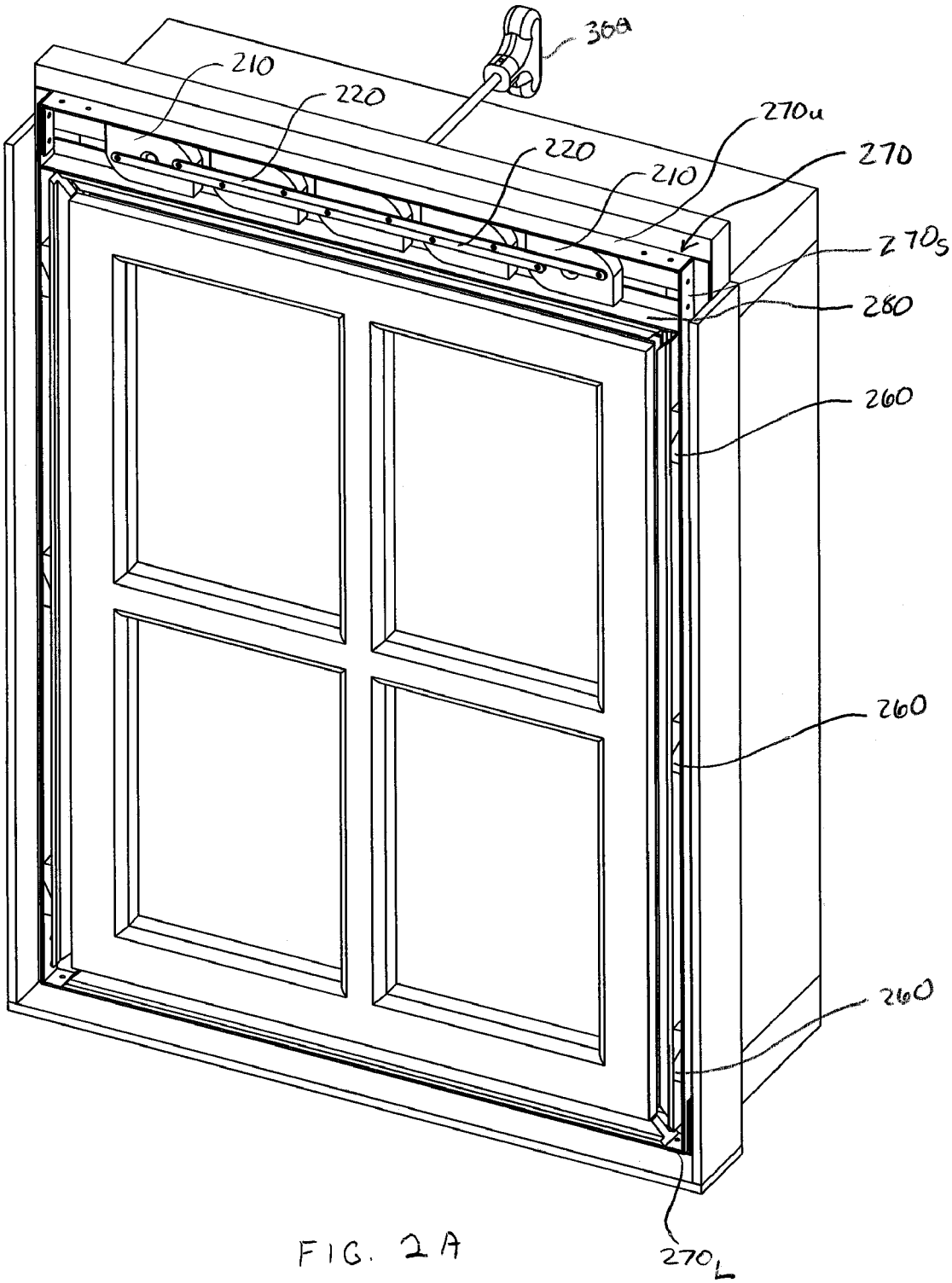
FIGS. 2A-2C are perspective views of sealing systems of the door/window system, respectively, in an unlocked, partially engaged, and locked configurations in accordance with the inventive arrangements.
Figure 2B:
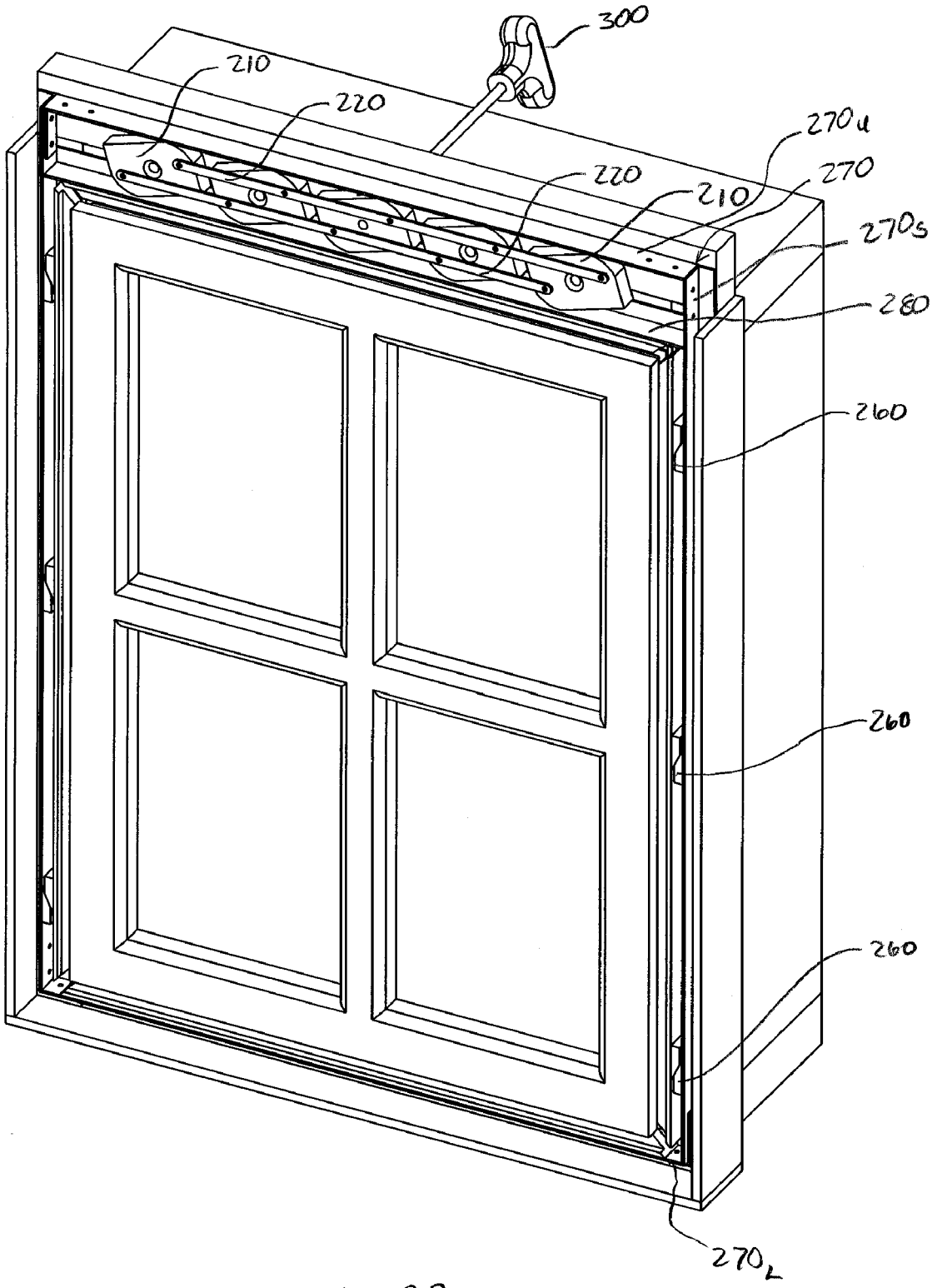
Figure 2C:
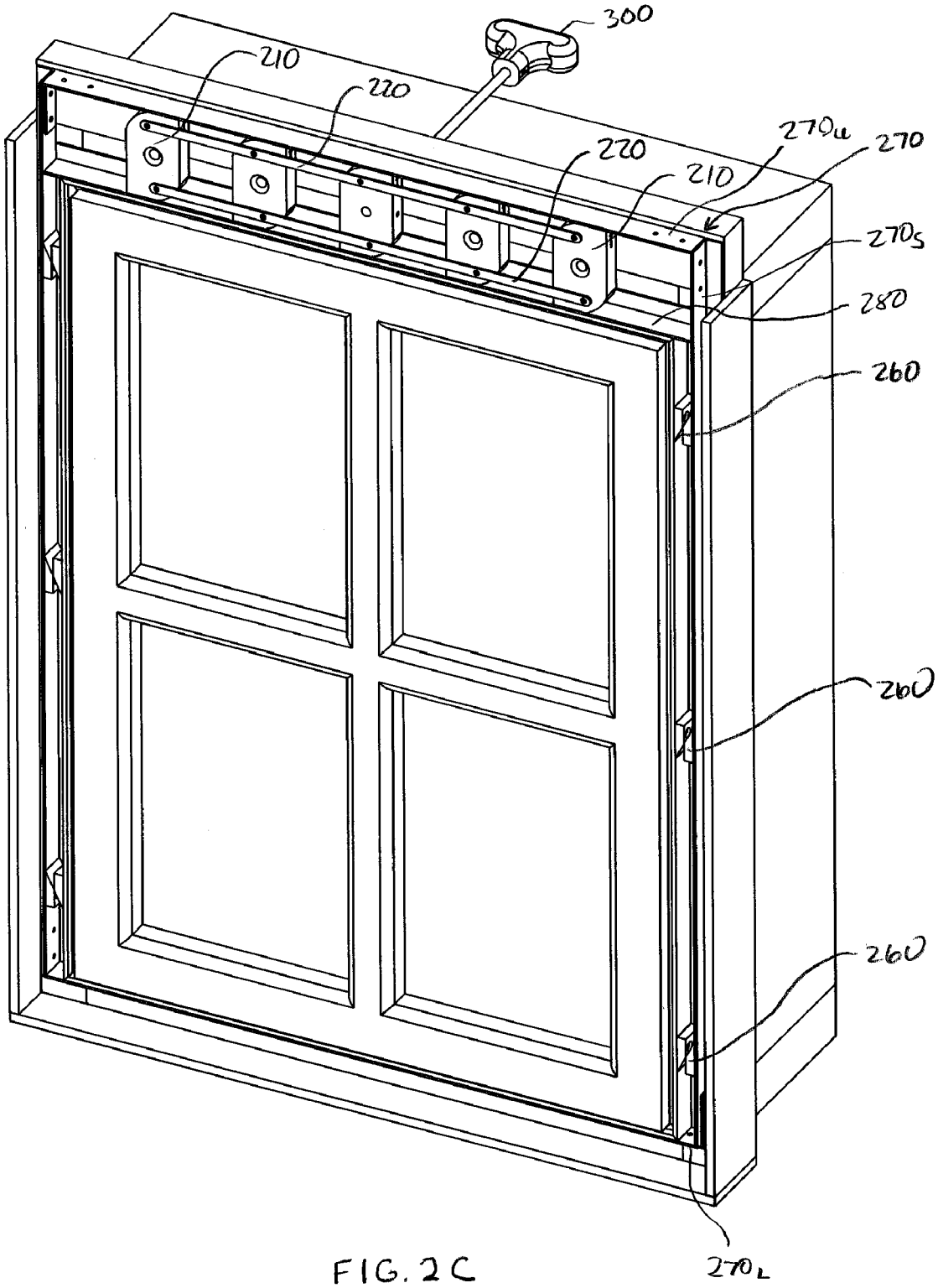
Figure 3A:
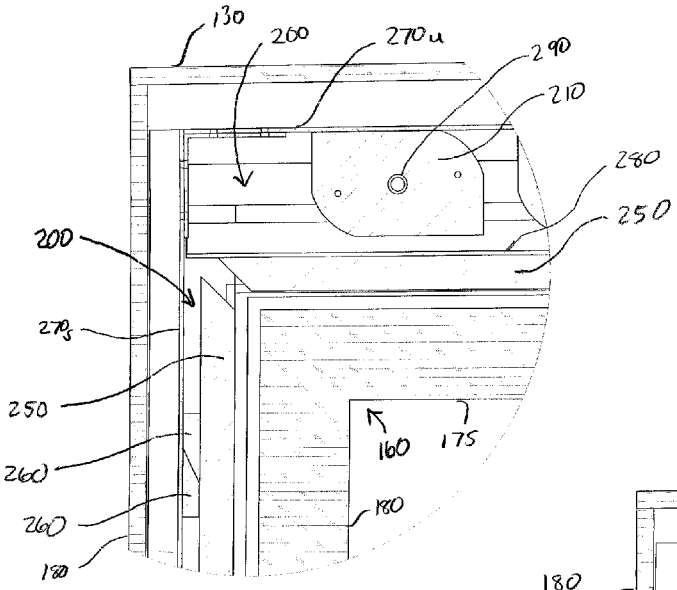
FIGS. 3A-3C are partial front views of upper and side sealing systems, respectively, in the unlocked, partially engaged, and locked configurations.
Figure 3B:
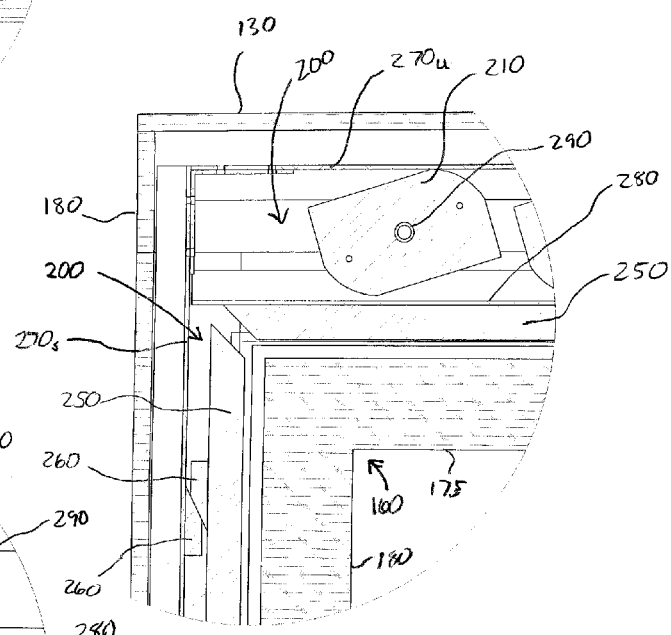
Figure 3C:
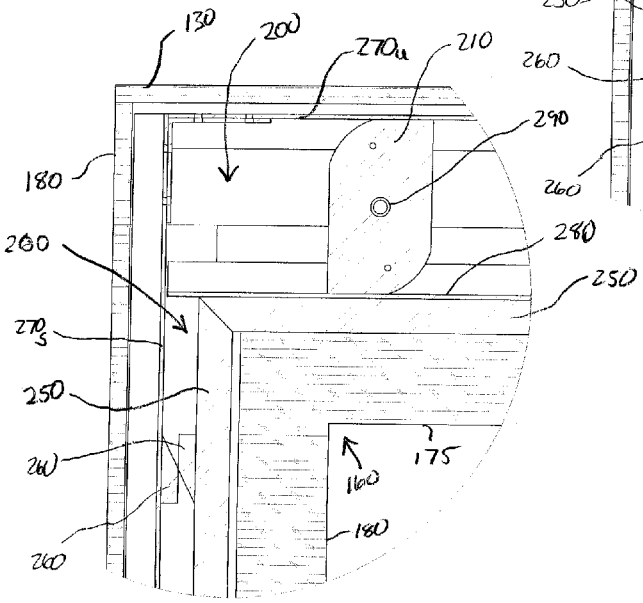
Figure 4A:
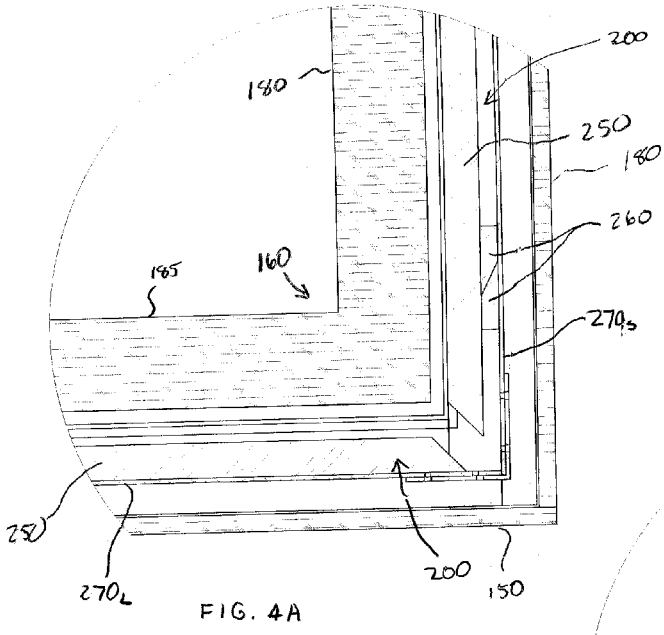
FIGS. 4A-4C are partial front views of lower and side sealing systems, respectively, in the unlocked, partially engaged, and locked configurations.
Figure 4B:
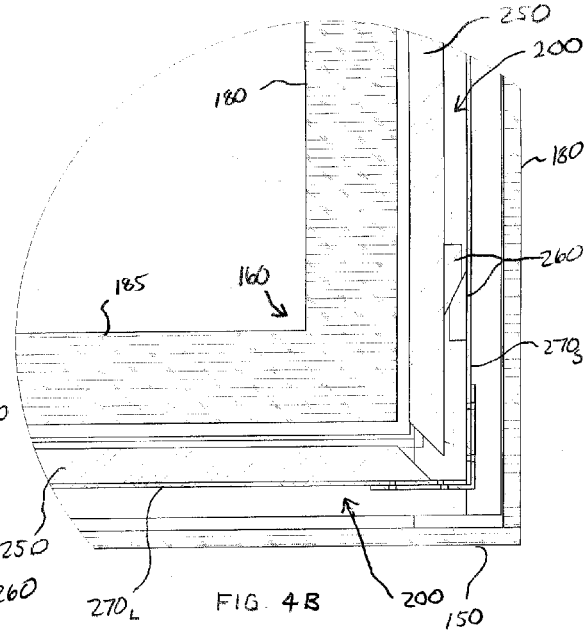
Figure 4C:
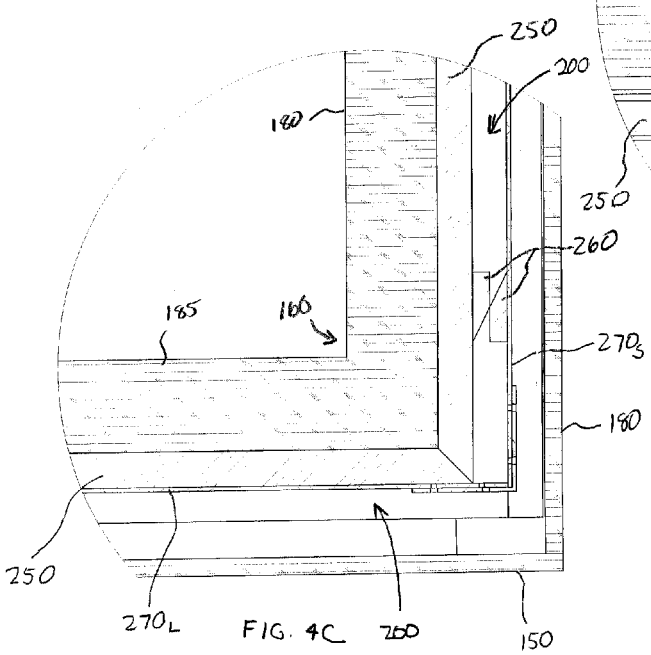
Figure 5A:
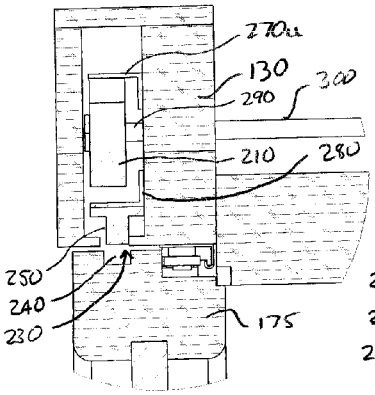
FIGS. 5A-5C are cross-sectional views of the sealing system positioned within a header and header rail of the door/window system, respectively, in the unlocked, partially engaged, and locked configurations.
Figure 5B:
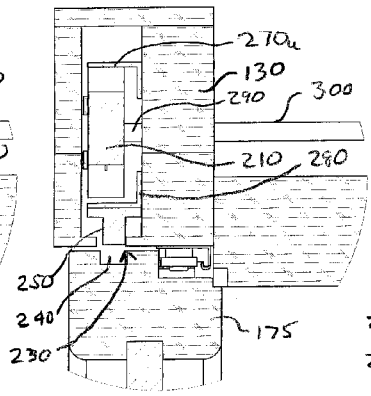
Figure 5C:
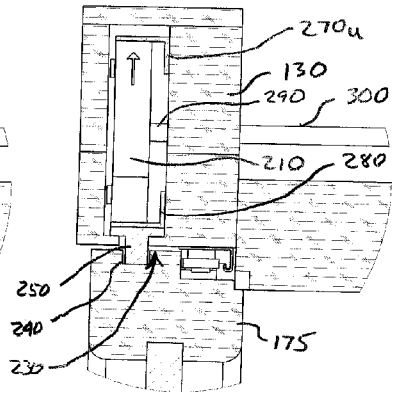
Figure 6A:
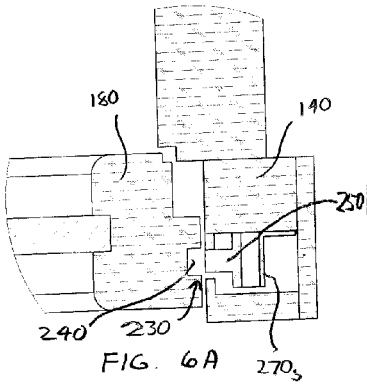
FIGS. 6A-6C are cross-sectional views of the sealing system positioned within a jamb and stile rail of the door/window system, respectively, in the unlocked, partially engaged, and locked configurations.
Figure 6B:
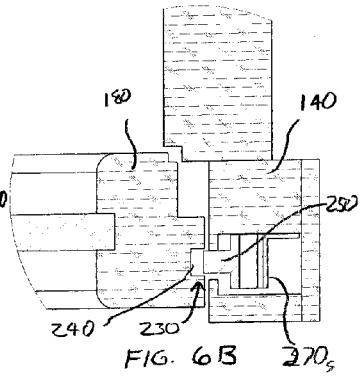
Figure 6C:
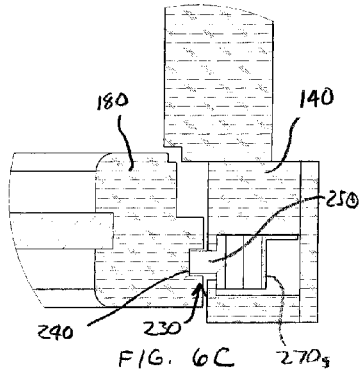
Figure 7A:
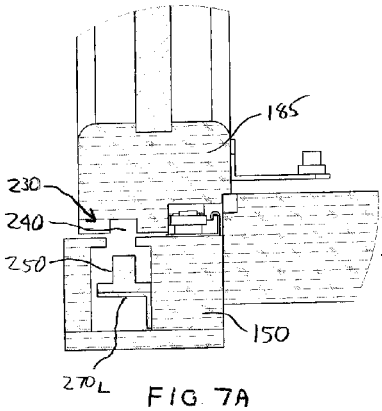
FIGS. 7A-7C are cross-sectional views of the sealing system positioned within a sill and sill rail of the door/window system, respectively, in the unlocked, partially engaged, and locked configurations.
Figure 7B:
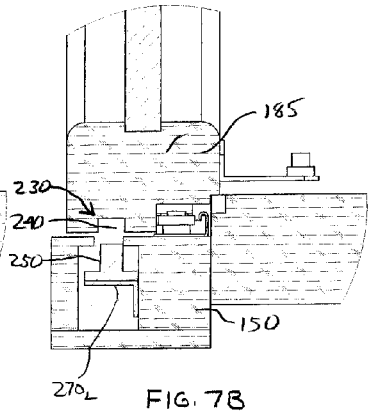
Figure 7C:
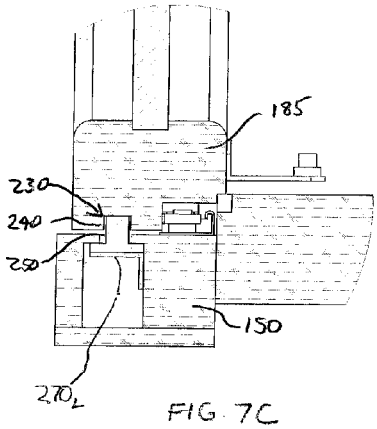

A closing system 300 moves the sealing system 200 from the unlocked configuration (e.g., FIGS. 2A, 3A, 4A) to a locked configuration (e.g., FIGS. 2C, 3C, 4C). The closing system 300 may also move the sealing system 200 from the locked configuration to the unlocked configuration. How the closing system 300 moves the sealing system 200 from the unlocked configuration to the locked configuration (and back again) is not limited as to a particular manner and/or device. As can be readily envisioned, the configuration and operation of the closing system 300 may be determined by the configuration and operation of the sealing systems 200. An example of the sealing system 300 employs the use of a wrench to rotate a portion of one of the sealing systems 200. Although this closing system 300 is shown as being manually operated, other devices capable of moving a sealing system 200 are commonly known, such as magnetic, mechanical, and electromechanical devices.

As will be discussed subsequently in greater detail, the closing system 300 may be configured to simultaneously move each of the separate sealing systems 200. In other aspects of the door/window system 100, however, multiple closing systems 300 may be provided to separately close one or multiple sealing systems 200.

Referring to FIGS. 3A-3C and 4A-4C, operation of the sealing systems 200 will be described. At least one of the sealing systems 200 may include at least one cam 210. Although not limited in this manner, the cam 210 can be fixed in position by being rotated about a pivot 290 connected to the frame 120. Upon being rotated, the cam 210 engages opposing surfaces $\mathbf{270}_U$ and 280, which acts to separate these surfaces $\mathbf{270}_U$ and 280. One (i.e., seal connecting member 280) of these surfaces is connected, either directly or indirectly, to a portion 250 of a seal 230 (the complete seal 230 is shown in FIGS. 5A-5C, 6A-6C, 7A-7C) between the frame 120 and the sash 160, and movement of the cam 210 causes engagement and/or disengagement of the seal 230. Although not limited to this particular location, in certain aspects of the door/window system 100, the cam 210 is located within the header 130 of the frame 120. For example, in other aspects of the door/window system 100, the cam 210 may be located within one of the jambs 140 or the sill 150.

The sealing system 200 may include a plurality of cams 210 and one or more cam connecting members 220 (see FIGS. 2A-2C) for interconnecting the plurality of cams 210. In this manner, rotation of one of the cams 210, for example by the closing system 300, causes the other cams 210 to rotate.

Movement of one of the sealing systems 200, for example, through movement of the cams 210, may also be employed to move another one of the sealing systems 200. For example, a sealing frame 270 may be provided to transfer motion of an upper member $\mathbf{270}_U$ of the sealing frame 270 to a lower member $\mathbf{270}_L$ of the sealing frame 270. Although not limited in this manner, the upper member $\mathbf{270}_U$ may be connected to the lower member $\mathbf{270}_L$ via a pair of side members $\mathbf{270}_S$ of the sealing frame 270.

As shown in FIGS. 3A-3C, movement of the cam 210 against the upper member $\mathbf{270}_U$ forces the upper member $\mathbf{270}_U$ away from the sash 160, and as shown in FIGS. 4A-4C, the movement of the upper member $\mathbf{270}_U$ away from the header rail 175 of the sash 160 causes a corresponding movement of the lower member $\mathbf{270}_L$ towards the sill rail 185 of the sash 160. The lower member $\mathbf{270}_L$ is connected, either directly or indirectly, to a portion 250 of a seal 230 between the frame 120 and the sash 160, and the upward movement of the lower member $\mathbf{270}_L$ causes engagement of the seal 230. Although not illustrated, a guide member, such as a pin extending from the frame 120 and through the portion 250 of the seal 230, may be used to maintain a desired relative position of the portion 250 to the sash 160.

The up and down movement of the sealing frame 270 may also be employed to move additional sealing systems 200. For example, both of the sealing systems 200 respectively between the two stile rails 180 of the sash 160 and the two jambs 140 of the frame 120 may be engaged and/or disengaged through movement of the sealing frame 270. Each of these sealing systems 200 may include one of the side members $\mathbf{270}_S$ of the sealing frame 270 and one or more proximate pairs of steps 260. One of the proximate pair of steps 260 is connected to the side member $\mathbf{270}_S$, and the other of the proximate pair of steps 260 is connected, either directly or indirectly, to a portion 250 of a seal 230 between the frame 120 and the sash 160.

Movement of the side member $\mathbf{270}_S$ relative to the portion 250 of the seal 230 causes the proximate pairs of steps 260 to engage one another and to separate a distance between the side member $\mathbf{270}_S$ and the portion 250 of the seal 230, and any configuration of steps 260 so capable is acceptable for use with the sealing system 200. For example, one of the steps 260 may include an inclined surface between first and second levels of the step 260 and the other of the steps 260 may include a roller. Also, one of the steps 260 may include first and second levels having different distances from the other step 260 such that, as the roller moves on an inclined surface from a first level to a second level, a distance between the proximate pair of steps 260 increases (or decreases).

The sealing systems 200 are not limited as to the particular manner in which the sealing system 200 is positioned from the locked configuration to the unlocked configuration. For example, after movement of the upper member $\mathbf{270}_U$ away from the seal connecting member 280 to cause engagement of the sealing system 200, a resilient member (or other device) may move the upper member $\mathbf{270}_U$ towards from the seal connecting member 280 to disengage the sealing system 200. As previously described, the engagement of one sealing system 200 may cause the engagement of one or more of the other sealing systems 200. In the same manner, the disengagement of one sealing system 200 may cause the disengagement of one or more of the other sealing systems 200.

FIGS. 5A-5C, 6A-6C, 7A-7C further illustrate details of the sealing systems 200 and the seal 230. Although not limited in this particular manner, each seal 230 may include an anchor 250 and a slot 240 into which the anchor 250 is positioned. Although the slot 240 may be positioned in the frame 120 and the anchor 240 may be positioned in the sash 160, in certain aspects of the door/window system 100, the slot 240 is positioned in the sash 240 and the anchor 250 is positioned in the frame 120.

Not only is the anchor 250 positioned within the slot 240, the anchor 250 may engage a surface of the slot 240 to prevent environmental elements, such as noise, weather, water, and insects, from passing the seal 230. Additionally, as shown in FIGS. 3A-3C and 4A-4B, adjacent seals 230 may include anchors 250 that inter-engage one another. In this manner, all the seals 230 may be interconnected and surround the panel 110. The manner in which the anchors 250 inter-engage one another is not limited as to a particular configuration or device. However, in certain aspects, the adjacent anchors 250 include angled surfaces at their distal ends that mate with one another.

What is claimed is:

1. A combined sealing system for connecting a panel to a frame, comprising:

a first sealing system for connecting a first surface of the panel to a first surface of the frame; and a second sealing system for connecting a second surface of the panel to a second surface of the frame, wherein the first surface of the panel different than the second surface of the panel, and the first and second sealing systems having a locked configuration and an unlocked configuration upon the panel being positioned within the frame, wherein the first sealing system includes an anchor positioned in one of the frame and the panel and a slot positioned in an other of the frame and the panel.

2. The combined sealing system of claim 1, wherein the panel pivots relative to the frame.

3. The combined sealing system of claim 1, wherein sealing systems are provided to respectively connect all pairs of adjacent surfaces of the panel and the frame.

4. The combined sealing system of claim 3, wherein engagement of the first sealing system causes engagement of all sealing systems.

5. The combined sealing system of claim 1, wherein engagement of the first sealing system causes engagement of the second sealing system.

6. The combined sealing system of claim 1, wherein the first sealing system provides a seal between an entire first surface of the panel to the first surface of the frame.

7. The combined sealing system of claim 1, wherein the first sealing system is adjacent to and engages the second sealing system.

8. The combined sealing system of claim 1, wherein the anchor is positioned in the frame in an unlocked configuration and the slot is positioned in the panel.

9. The combined sealing system of claim 8, wherein in the locked configuration, the anchor engages a surface of the slot to form a seal between the anchor and the slot.

10. A combined sealing system for connecting a panel to a frame, comprising:

a first sealing system for connecting a first surface of the panel to a first surface of the frame; and a second sealing system for connecting a second surface of the panel to a second surface of the frame, wherein the first surface of the panel different than the second surface of the panel, the first and second sealing systems having a locked configuration and an unlocked configuration upon the panel being positioned within the frame, the first sealing system includes at least one cam positioned within the frame, the cam engages a sealing frame, the sealing frame engages the second sealing system, the sealing frame engages a third sealing system and a fourth sealing system, and the third and fourth sealing systems each include at least one adjacent pair of steps.

11. The combined sealing system of claim 10, wherein the first surface of the panel is positioned opposite the second surface of the panel.

12. The combined sealing system of claim 10, wherein relative movement between the adjacent pair of steps causes engagement of the third and fourth sealing systems.

13. The combined sealing system of claim 10, wherein one of the adjacent pair of steps is connected to the sealing frame.

14. A combined sealing system for connecting a panel to a frame, comprising:

a first sealing system for connecting a first surface of the panel to a first surface of the frame;

a second sealing system for connecting a second surface of the panel to a second surface of the frame; and a sealing frame connecting the first sealing system to the second sealing system, wherein the first surface of the panel different than the second surface of the panel, and the first and second sealing systems having a locked configuration and an unlocked configuration upon the panel being positioned within the frame, wherein the sealing frame engages a third sealing system and a fourth sealing system.

* * * * *